United States Patent [19]

Barnard

[11] 4,228,573

[45] Oct. 21, 1980

[54] METHOD FOR ASSEMBLING HEAT EXCHANGERS

[75] Inventor: James A. Barnard, Olcott, N.Y.

[73] Assignee: General Motors Corporation, Detroit, Mich.

[21] Appl. No.: 53,361

[22] Filed: Jun. 29, 1979

[51] Int. Cl.[3] ..... B23P 15/26

[52] U.S. Cl. ..... 29/157.3 R; 29/157.3 B; 113/116 BB; 113/118 V; 113/1 C

[58] Field of Search ..... 29/157.3 B, 157.3 A, 29/157.3 C, 157.3 R; 113/116 BB, 116 UT, 116 V, 116 Y, 11 A, 1 C, 118 A, 118 B, 118 V, 118 R

[56] References Cited

U.S. PATENT DOCUMENTS 4,175,309 11/1979 Barnard ..... 29/157.3 R

*Primary Examiner*—Francis S. Husar
*Assistant Examiner*—V. K. Rising
*Attorney, Agent, or Firm*—R. L. Phillips

[57] ABSTRACT

Method and apparatus are disclosed for rapidly assembling a heat exchanger comprised of perforated fins, a pair of perforated headers and a plurality of reverse bent tubes as the fins are being stamped from sheet stock. The parts are assembled on a pallet fixture which is advanced by a continuously moving conveyor to various work stations. At each work station, the pallet fixture is lifted and then held in a predetermined position overhead the conveyor while an assembly operation operated from one side of the conveyor is performed thereon whereafter the pallet fixture is lowered onto the conveyor.

1 Claim, 10 Drawing Figures

FROM HOPPER
FIRST HEADER LOADER STATION
30
FIRST HAIRPIN TUBE LOADER STATION

METHOD FOR ASSEMBLING HEAT EXCHANGERS

This invention relates to method and apparatus for assembling heat exchangers and more particularly to method and apparatus for rapidly assembling heat exchangers having a plurality of perforated fins, a pair of perforated headers and a plurality of reverse bent tubes.

Typically, the assembly line production of heat exchangers such as air conditioner condenser utilizes both hand operations and assembly machine operations to assemble the fins, headers and reverse bent tubes which are commonly referred to as hairpin tubes. For example, at the beginning of the line, there is typically provided a work fixture on which one of the headers is located. As the fins are being stamped from sheet stock, they are collected against the one header on the fixture. When the proper number of fins have been collected on the fixture, an operator then hand inserts several of the hairpin tubes through the one header and fins to establish their alignment whereafter this fin and partial tube assembly is then removed from the fixture and other operators down the line insert the remaining hairpin tubes and then the other header. This assembly is then routed to a tube expander machine to expand the hairpin tubes into a tight fit with both the headers and the fins. Thereafter, 180° elbows are hand fitted and sealingly joined to the open ends of the hairpin tubes to establish series connection between the tube passes.

The present invention is directed to automating the assembly of the headers, fins and hairpin tubes prior to the fitting of the elbows and in a manner which minimizes the amount of floor space required for the line as well as both the transfer time and work time at the work stations. This is accomplished by accumulating the fins in their normal face-to-face relationship and in stacks of predetermined number at a fin accumulator and transfer station immediately following their stamping. At this station, successive stacks of accumulated fins are then periodically fed to and oriented on a stationary path with their faces vertical to the path and transverse to the sides thereof whereby a column of fins in face-to-face relationship is continuously formed and is advanced as stacks of fins following stamping continue to be fed thereto. Thereafter, a complete assembly or pack of fins is separated from the head of the column and transferred at a fin feeder station onto a pallet fixture that has been lifted and held in a predetermined position directly above an endless, continuously moving conveyor extending transverse to the fin feeder path. The fin pack is clamped to the pallet fixture which is then lowered onto the moving conveyor with the faces of the fins thus oriented parallel to the sides of the conveyor. Depending on assembly demand, the pallet fixture with the fin pack clamped thereon may be selectively removed from the conveyor to an overhead storage station above the conveyor and subsequently returned to the conveyor when needed.

At a first header loader station, the pallet fixture is lifted from the conveyor and while held in a predetermined position directly thereabove, one of the headers is then located in alignment with and clamped against one of the two opposite ends of the fin pack. Thereafter, the pallet fixture is lowered to the conveyor and advanced to the first of two hairpin tube loader stations.

At the first hairpin tube loader station, it is lifted directly overhead the conveyor and while held in a predetermined position directly thereabove, half of the hairpin tubes are inserted through the one header and the fin pack. Thereafter, the pallet fixture is lowered onto the conveyor and advanced thereby to the second hairpin tube loader station where the other half of the hairpin tubes are inserted. From the second hairpin tube loader station, the pallet fixture with the fin pack, one header and all the hairpin tubes is then transported by the conveyor to a second header loader station where it is lifted from the conveyor and while held in a predetermined position directly thereabove, the other header is inserted onto the ends of the hairpin tubes and clamped against this end of the fin pack. The pallet fixture is then lowered onto the conveyor and is advanced to one of two tube expander stations dependent on which is then empty.

At the receiving tube expander station, the pallet fixture is lifted directly overhead the conveyor at which time the hairpin tubes are radially expanded to grip the fins and headers. The thus assembled fins, headers and hairpin tubes are returned on the pallet fixture to the conveyor and then conveyed thereby to an unloading station where the assembled heat exchanger parts are removed and the empty pallet fixture is then returned by the conveyor for repeat of another assembly thereon.

These and other objects and advantages and features of the present invention will be more apparent from the following description and drawings in which.

Figure 1:
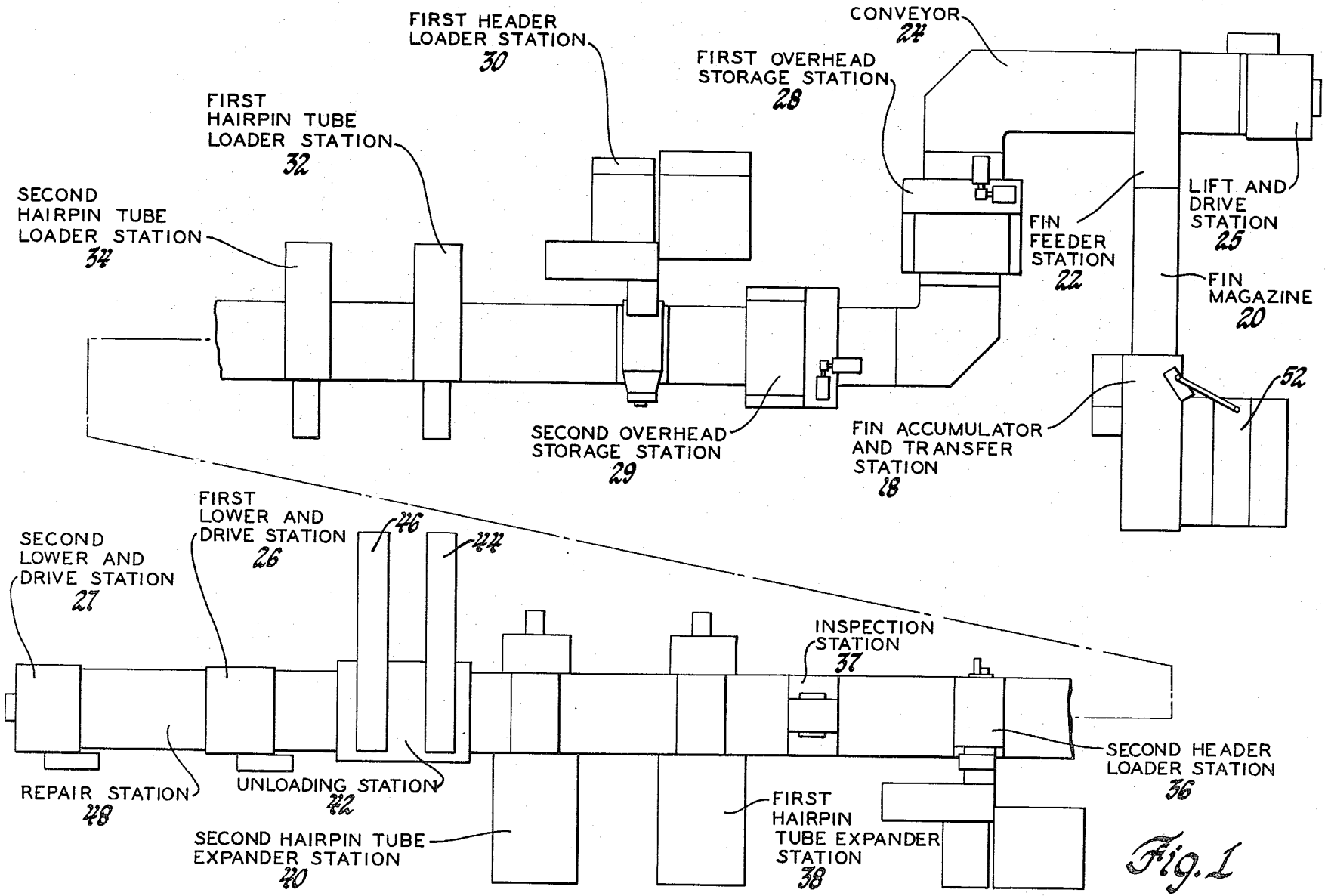
FIG. 1 is a diagrammatic view of the preferred arrangement of the apparatus for assembling a heat exchanger according to the present invention.
Figure 10:
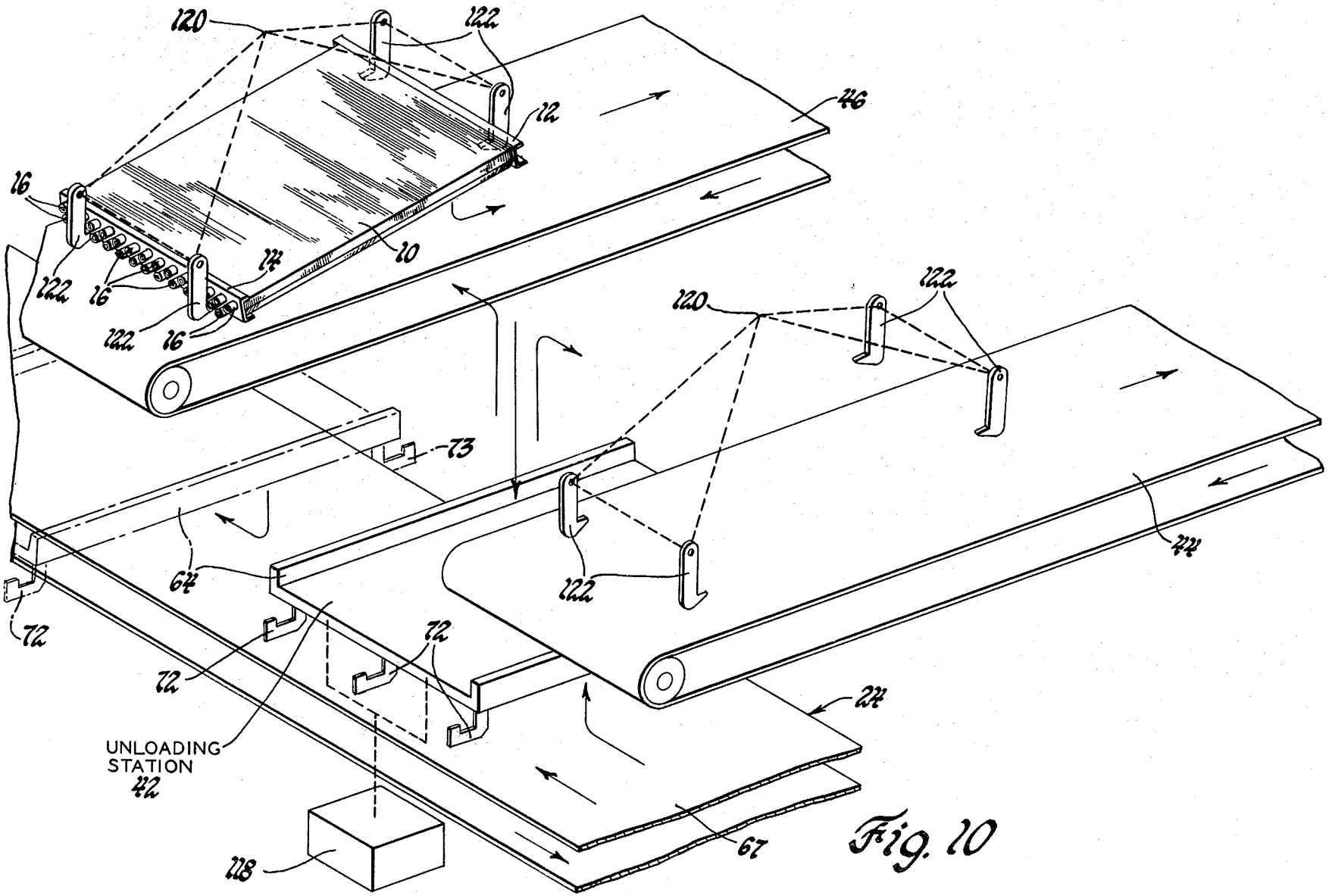
FIG. 10 is a diagrammatic view in perspective of the unloading station in FIG. 1 including a perspective view of a heat exchanger that has been assembled.

There is shown in FIG. 1, an assembly line for automatically assembling a heat exchanger which as shown in FIG. 10 is comprised of perforated fins 10, a pair of perforated headers 12, 14 and a plurality of hairpin tubes 16. The assembly line comprises a fin accumulator and transfer station 18, a fin magazine 20, a fin feeder station 22, an endless conveyor 24 including a lift and drive station 25 and first and second lower and drive stations 26, 27 first and second overhead storage stations 28, 29, a first header loader station 30, first and second hairpin tube loader stations 32, 34, a second header loader station 36, an inspection station 37, first and second hairpin tube expander stations 38, 40, an unloading station 42 including two belt conveyors 44 and 46, and a repair station 48.

Figure 2:
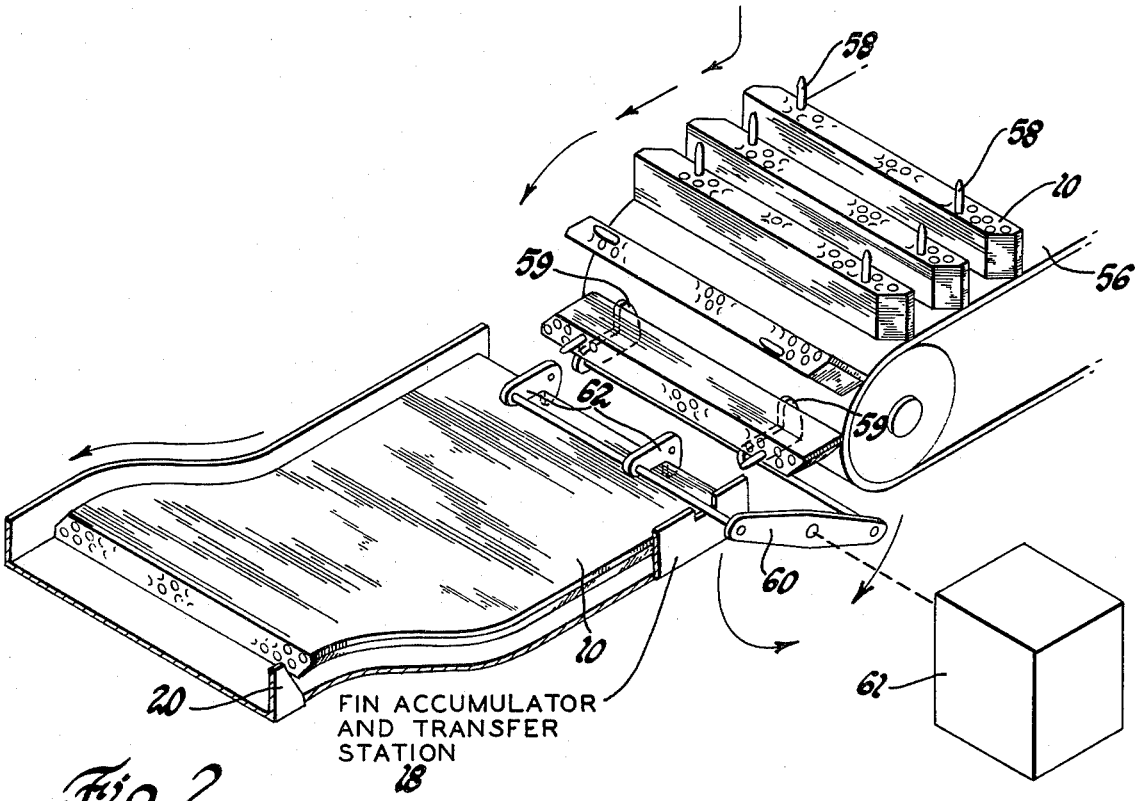
FIG. 2 is a diagrammatic view in perspective of the fin accumulator and transfer station in FIG. 1.
Figure 3:
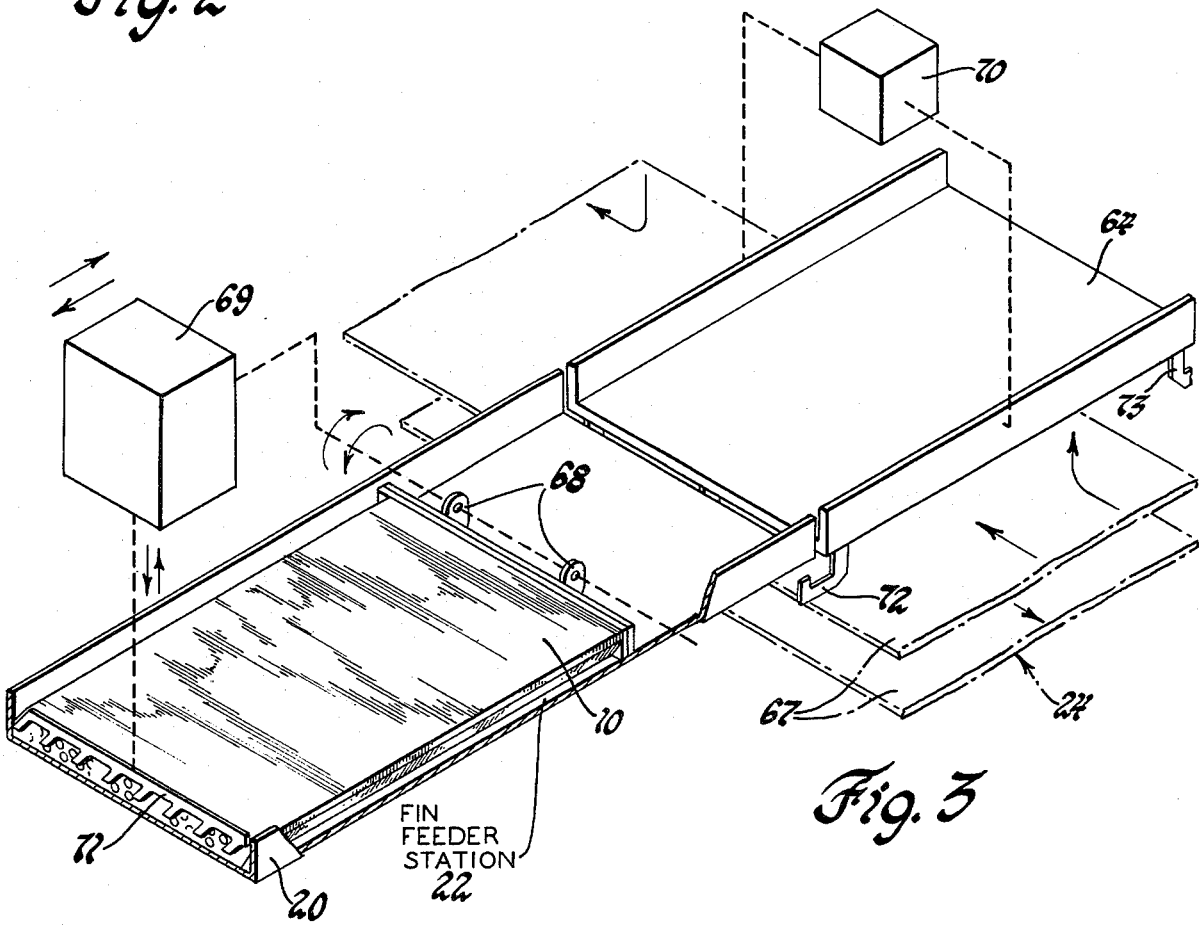
FIG. 3 is a diagrammatic view in perspective of the fin feeder station in FIG. 1.
Figure 4:
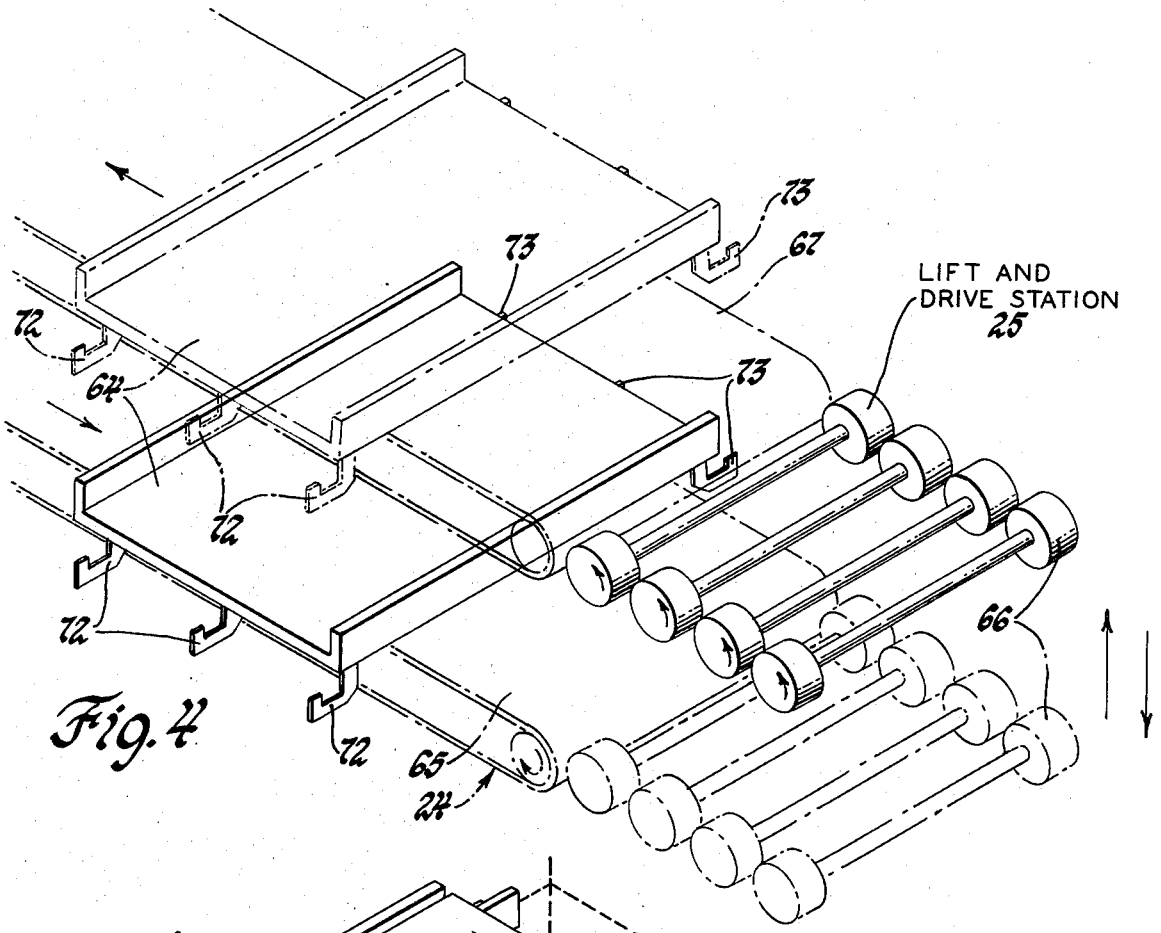
FIG. 4 is a diagrammatic view in perspective of the conveyor pallet fixture lift and drive station in FIG. 1.

The fins 10 are stamped from sheet stock by a stamping press 52 and are accumulated or collected in stacks at the fin accumulator and transfer station 18 as shown in FIG. 2 by a fin harvester or accumulator 56 which has bayonets 58 thereon on which the fins are dropped in nesting face-to-face relationship. The fin accumulator 56 indexes to bring the stacks of fins to an unload position where a rake 59 of a linkage 60 driven by a rotary drive mechanism 61 sequentially removes the stacks from the accumulator to an intermediate position under a second rake 62 of the linkage. The rake 62 then rakes the stack of fins from the rake 59 onto the fin magazine 20 as the latter rake returns to await the next stack of fins from the accumulator. Thus, the groups or stacks of fins are sequentially fed and oriented onto the fin magazine with their faces vertical to the path along the magazine and transverse to the sides thereof whereby a column of fins in face-to-face relationship is formed and advanced along the path of the magazine and toward the fin feeder station 22 shown in FIG. 2 as groups of fins following stamping continue to be fed or cycled thereto. Meantime, a pallet fixture 64 has been propelled along the lower level 65 of the conveyor 24 as shown in FIG. 4 until it rolls onto wheels 66 of the lift and drive station 25. The pallet fixture is then lifted thereby to the upper conveyor level 67 and the wheels 66 are activated and the pallet fixture is propelled onto the upper conveyor level which advances it to the fin feeder station 22 as shown in FIG. 3. The wheels 66 are then deactivated and lowered to the lower conveyor level so that the lift and drive station is then ready for a following pallet fixture.

At the fin feeder station 22, the column of fins is advanced against a stop 68 which is positioned across the path thereof by a push-pull and rotary drive mechanism 69 which serves as a fin pack feeder. Meantime, the pallet fixture 64 that has been advanced to this station is lifted by a lift-lower mechanism 70 and held in a position overhead the conveyor and in alignment with the fins 10 in the fin magazine. At this time, the fin pack feeder mechanism 69 then extends rake 71 downward into the column of fins separating the desired number or pack of fins for the heat exchanger between the stop 68 and the rake 71. Then the fin pack feeder mechanism operates to advance the separated fin pack onto the pallet fixture 64. With the fin pack thus positioned on the pallet fixture, a set of clamps 72 and 73 at opposite ends of the pallet fixture are operated to clamp the fin pack to the fixture whereafter the fin pack feeder mechanism 69 then pivots the stop 68 to clear the fin pack and returns the stop and rake 71 to their original position where the stop is then pivoted downward into the path of the advancing fin column in the fin magazine while the fingers are retracted upward for a repeat cycle. Next, the lift-lower mechanism 70 operates to lower the pallet fixture 64 with the fin pack clamped thereon onto the conveyor for advancement to the two overhead storage stations 28 and 29.

Figure 5:
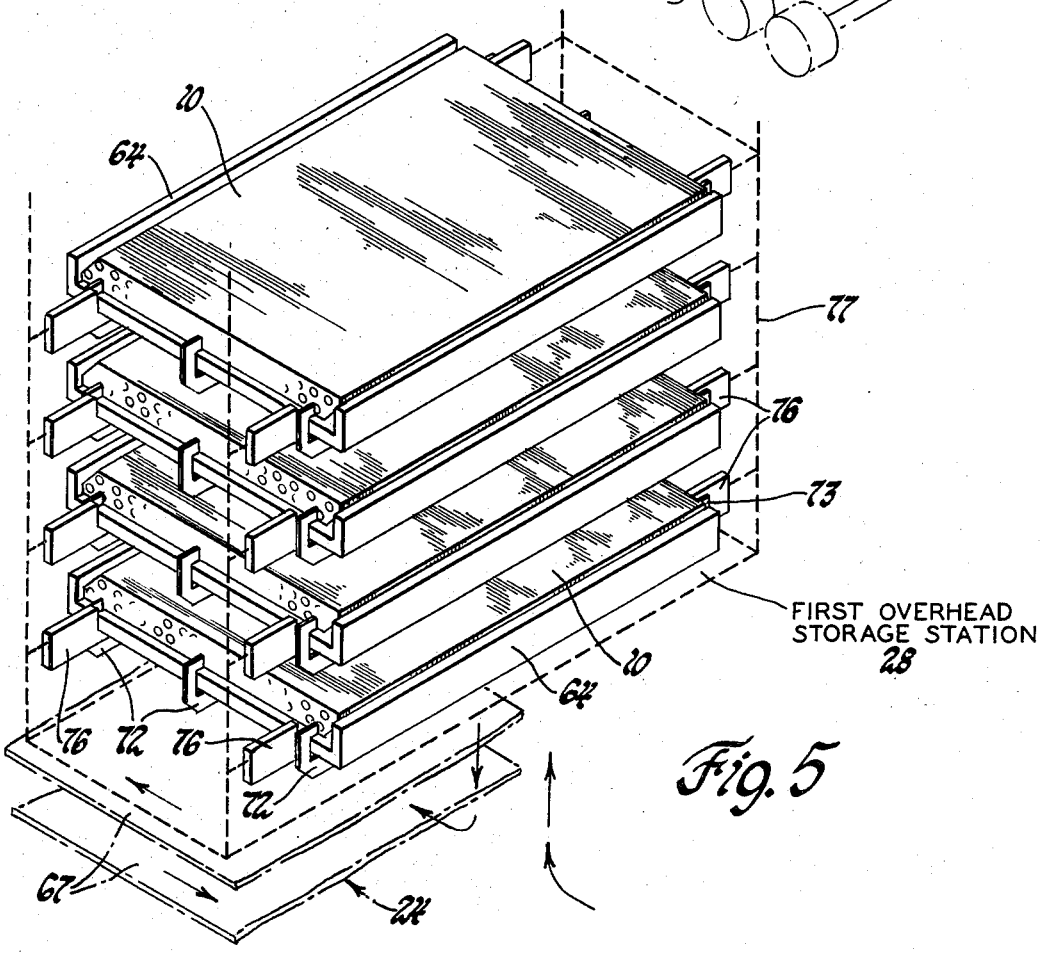
FIG. 5 is a diagrammatic view in perspective of the first overhead storage station in FIG. 1.

The overhead storage stations 28 and 29 are identical and have a vertically arranged storage capacity for a large number of thus loaded pallet fixtures as shown in FIG. 5. At each of the overhead storage stations 28 and 29, and if any of the work stations downstream thereof have not completed their cycles, the advancing pallet fixture with the fin pack clamped thereon is lifted up off the conveyor by pairs of fingers 76 on a vertical lift 77 and stored directly overhead. Then when the conveyor downstream is caught up, the stored pallet fixtures are returned to the conveyor as required.

Figures 6, 7:
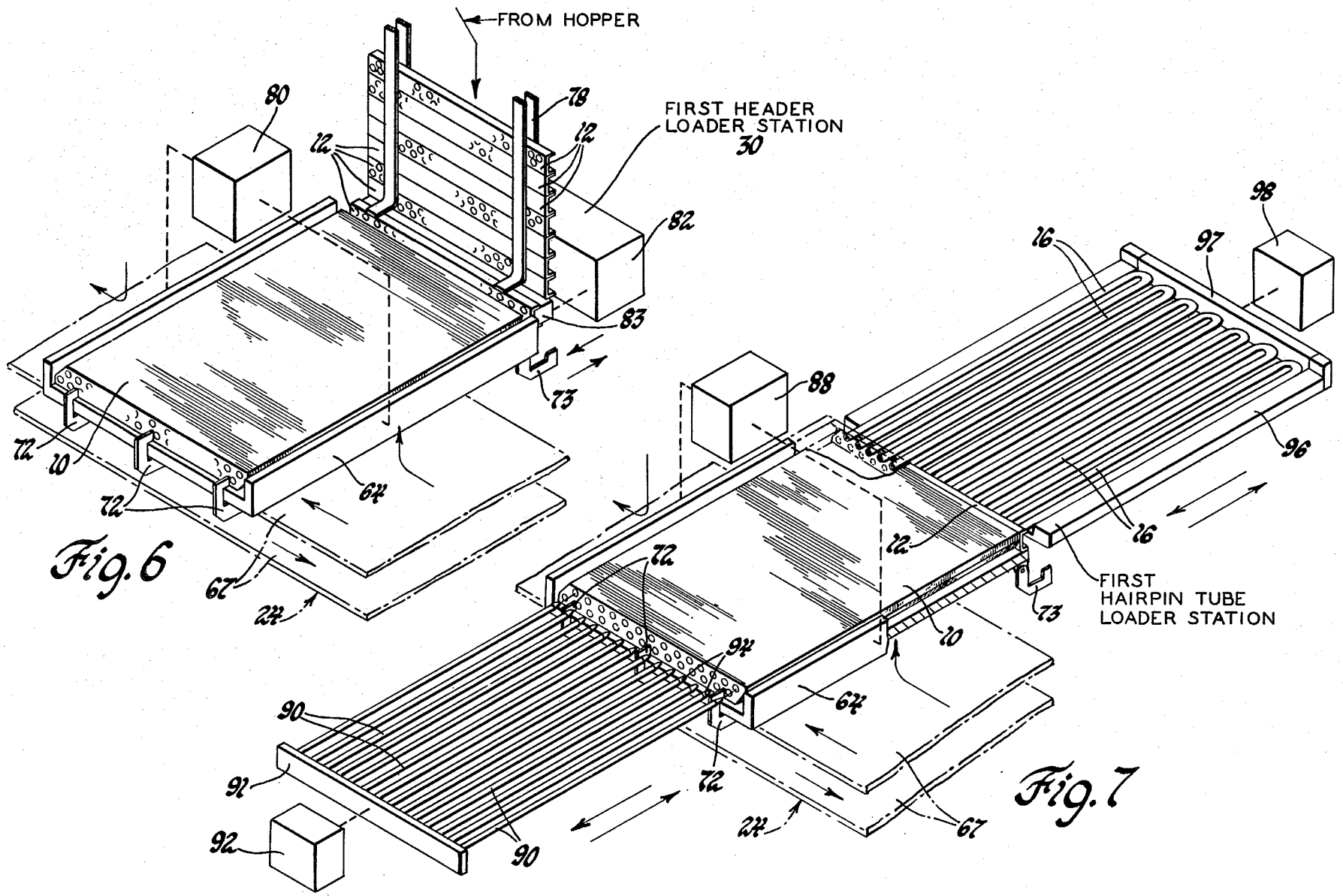
FIG. 6 is a diagrammatic view in perspective of the first header loader station in FIG. 1.
FIG. 7 is a diagrammatic view in perspective of the first hairpin tube loader station in FIG. 1.

After the pallet fixture passes the second overhead storage station 29, it is received at the first header loader station 30 as shown in FIG. 6. At this station, the headers 12 are fed from an overhead hopper down a chute 78 into a load position at one side of and a predetermined position above the conveyor. When the pallet fixture with the fin pack clamped thereon arrives at the first header loader station, it is then lifted up off the conveyor by a lift-lower mechanism 80 and held in an overhead position so that the fin pack at this end is aligned with the lower-most preloaded header. The pallet fixture clamps 73 at this end are then pivoted downward out of the way and a push-pull mechanism 82 is then operated to push the loaded header 12 from the chute 78 with a pusher 83 and into place on the pallet fixture against this end of the fin pack in proper relationship therewith. The clamps 73 are then operated to swing upward and clamp the header plate 12 against the pack of fins 10 and the pusher is then retracted for a subsequent cycle. Then the lift-lower mechanism 80 is operated to lower the pallet fixture back onto the conveyor which then advances it to the first hairpin tube loader station 32.

When the pallet fixture arrives at the first hairpin tube loader station 32 as shown in FIG. 7, it thus has the pack of fins 10 and the one header 12 clamped in place. The pallet fixture is then lifted off the conveyor by a lift-lower mechanism 88 and held in a predetermined position overhead the moving conveyor. With the pallet fixture thus held in the elevated position, bayonets 90 at one side of the conveyor are then pushed by a pusher 91 of a push-pull mechanism 92 through the lower level of holes in the fin pack and then the header 12. The bayonets 90 extend past the header 12 and have tips 94 which enter the open ends of the hairpin tubes 16 which have been previously loaded onto a tray 96 on the opposite side of the conveyor. The hairpin tubes 16 are then pushed from the tray 96 by a pusher 97 of a push-pull mechanism 98 through the header 12 and then the pack of fins 10 as the bayonets 90 are retracted. The hairpin tube pusher 97 is then retracted leaving the lower level of hairpin tubes properly assembled. Thereafter, the pallet fixture is lowered back onto the conveyor by the lift-lower mechanism 88 and is advanced thereby to the second hairpin tube loader station 34 where the upper level of hairpin tubes are assembled in like manner.

Figure 8:
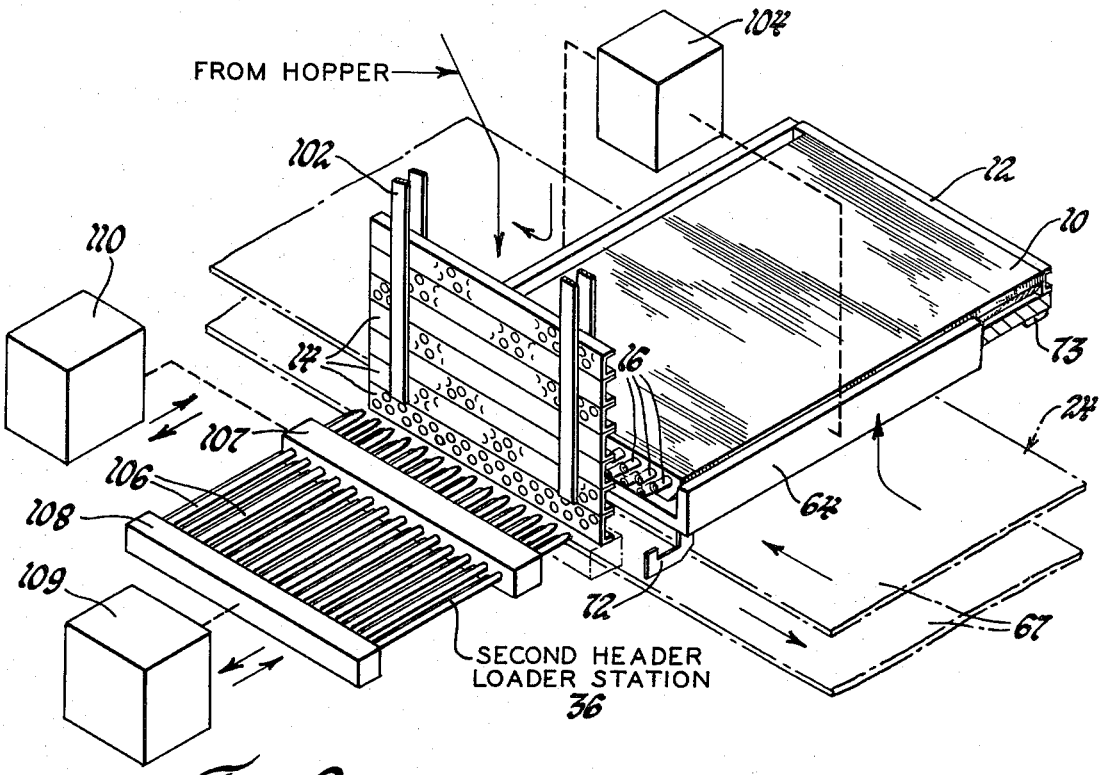
FIG. 8 is a diagrammatic view in perspective of the second header loader station in FIG. 1.

The pallet fixture with the pack of fins 10 the one header 12 and all the hairpin tubes 16 properly assembled thereon is then advanced by the conveyor to the second header loader station 36. At this station, as shown in FIG. 8, the headers 14 are fed from an overhead hopper down a chute 102 into a load position at a predetermined position above the conveyor and at the side thereof opposite from which the headers 12 are loaded. When the pallet fixture arrives at this station, it is then lifted by a lift-lower mechanism 104 and held in an overhead position so as to align with the lower-most preloaded header 14. At this time, the clamps 72 are pivoted downwardly out of the way and bayonets 106 which are located on this side of the conveyor and extend through a header pusher 107 are pushed by a pusher 108 of a push-pull mechanism 109 to extend through the header 14 and then a small distance into the open ends of the hairpin tubes. Then the header pusher 107 is operated by a push-pull mechanism 110 to push the header 14 along the bayonets 106 and thereby onto the ends of the hairpin tubes and against the fin pack at this end. Then the header pusher 107 and the bayonets 106 are retracted and thereafter the clamps 72 are pivoted upward to clamp the header 14 against the fin pack. Next, the pallet fixture is lowered by the lift-lower mechanism 104 back onto the conveyor which then advances it to the inspection station 37.

At the inspection station 37, an inspection is made with part presence sensors to determine whether or not all the parts are present. If all parts are present, the pallet fixture is then advanced by the conveyor to the first hairpin tube expander station 38. On the other hand, if something is missing, the succeeding work stations are signalled to permit the pallet fixture to pass directly onto the repair station 48 past the first lower and drive station 26. The pallet fixture is removed from the conveyor at the repair station and the assembly thereon is repaired if possible. If repaired, the pallet fixture with the repaired assembly is returned to the conveyor ahead of the first hairpin tube expander station 38. If not repairable, the pallet fixture is emptied and returned to the conveyor at the repair station for advancement to the second lower and drive mechanism. This station is similar to the lift and drive station 25 but operates in reverse manner so as to lower the empty pallet fixture to the lower conveyor level where it is returned thereby to the lift and drive station 25 and thus to the upper level 67 for advancement to the fin feeder station 22 to start another assembly.

Figure 9:
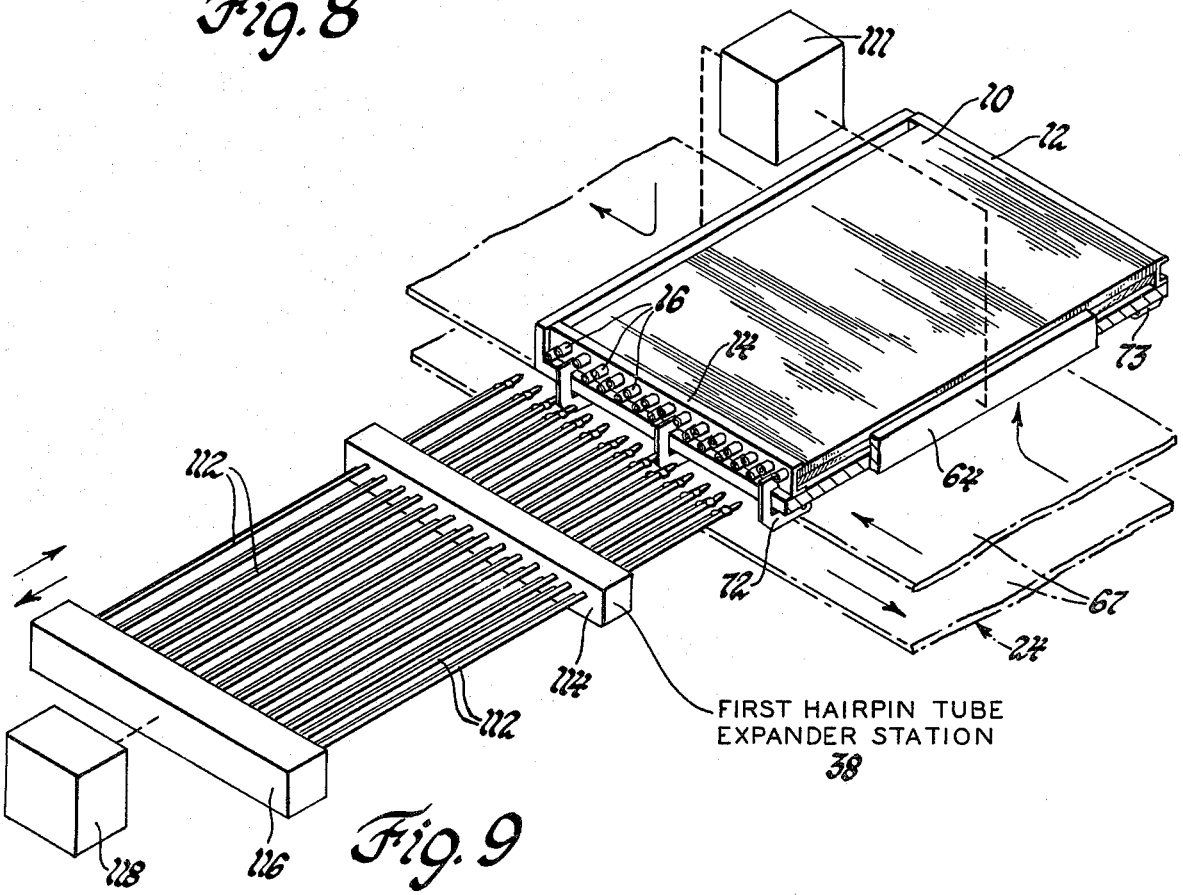
FIG. 9 is a diagrammatic view in perspective of the first hairpin tube expander station in FIG. 1.

With all parts present, the pallet fixture is stopped at one of the two hairpin tube expander stations 38 and 40 dependent on which one is then empty. The hairpin tube expander stations are identical and as shown in FIG. 9 have a lift- lower mechanism 111 which lifts the pallet fixture up off the conveyor. While held in elevated position above the conveyor, expander pins 112 which are guided in a stationary guide block 114 at one side of the conveyor are pushed by a pusher 116 of a push-pull mechanism 118 through the open ends of the tubes to thereby radially expand the tubes and establish a tight fit thereof with both the fins 10 and the headers 12 and 14. Upon completion of such expansion, the expander pins 112 are retracted and the lift-lower mechanism 110 is operated to lower the pallet fixture onto the conveyor.

This completes the automatic assembly of the fins, headers and hairpin tubes and upon return thereof on the pallet fixture to the coveyor, it is advanced to the unloading station 42 as shown in FIG. 10. At this station, the pallet fixture 64 is lifted by a lift-lower mechanism 118 to a predetermined position directly overhead the conveyor and held there. Both clamps 72 and 73 are then released and one of two overhead unloader heads 120 with fingers 122 then grasps the assembly while the pallet fixture is lowered back onto the conveyor. The assembly is then lifted and shuttle above conveyor belt 46. At the same time, the other unloader head is above the other conveyor belt 44 and is shuttled over the conveyor in preparation to unload a following pallet fixture with an assembly thereon. The assembly over conveyor belt 46 is then deposited thereon and the unloading station is thus ready for another unloading cycle in which the assembly will then be deposited on the conveyor belt 44.

After the pallet fixture has been unloaded and returned to the conveyor at the unloading station, it is advanced thereby to the first lower and drive station 26 which is similar to the lift and drive station 25 but operates in reverse manner so as to lower the empty pallet fixture to the lower level 65 of the conveyor where it is returned thereby to the lift and drive station 25 and thus to the upper level 67 for advancement to the fin feeder station 22 to have an assembly cycle repeated thereon.

Having shown and described the basic mechanisms and their operations at the various work stations, it will be understood by those skilled in the art, that the details of such apparatus may take various forms and thereof further disclosure thereof is unnecessary. Furthermore, it will be understood that the above described preferred embodiment is intended to be illustrative of the invention which may be modified within the scope of the appended claims.

The embodiments of the invention in which an exclusive property or privilege is claimed are defined as follows:

1. A method of assembling a heat exchanger comprised of perforated fins, a pair of perforated headers and a plurality or reverse bent tubes as the fins are being stamped from sheet stock, said method comprising:

accumulating the fins in face-to-face relationship and in stacks following their stamping, sequentially feeding the stacks of fins onto a stationary path with their faces vertical to the path and transverse to the sides thereof whereby a column of fins in face-to-face relationship is formed and advanced along the path as stacks of fins following stamping continue to be fed thereto, lifting a pallet fixture from an endless continuously moving conveyor and holding it in a predetermined position overhead thereof, separating a complete pack of fins for a heat exchanger from the head of the column in the time interval between an advancement and feeding the pack of fins onto the pallet fixture, clamping the pack of fins at opposite ends thereof to the pallet fixture and then lowering the pallet fixture onto the conveyor to be advanced thereby with the faces of the fins oriented parallel to the sides of the conveyor, lifting the advancing pallet fixture from the conveyor and holding it in a predetermined position overhead thereof while releasing the clamping from one end of the fin pack and guiding and then clamping one of the headers against this end of the fin pack and thereafter lowering the pallet fixture back onto the conveyor to be advanced thereby, lifting the advancing pallet fixture from the conveyor and holding it in a predetermined position overhead thereof while guidably inserting the reverse bent tubes through the one header and then the fin pack and thereafter lowering the pallet fixture back onto the conveyor to be advanced thereby, lifting the advancing pallet fixture from the conveyor and holding it in a predetermined position overhead thereof while releasing the clamping from the opposite end of the fin pack and guiding the other header onto the tubes and then forcing same against this end of the fin pack and thereafter clamping this header against this end of the fin pack and then lowering the pallet fixtue back onto the conveyor to be advanced thereby, lifting the advancing pallet fixture from the conveyor and holding it in a predetermined position overhead thereof while radially expanding the tubes to tightly engage both the fins and the headers and thereafter lowering the pallet fixture back onto the conveyor to be advanced thereby, and lifting the advancing pallet fixture from the conveyor and holding it in a predetermined position overhead thereof while unloading the thus assembled fin pack, headers and tubes therefrom and thereafter lowering the empty pallet fixture back onto the conveyor for its conveyance thereby to repeat another assembly of a heat exchanger thereon according to the above steps.

* * * * *